US009702075B2

(12) United States Patent
Kim et al.

(10) Patent No.: US 9,702,075 B2
(45) Date of Patent: Jul. 11, 2017

(54) LAUNDRY MACHINE

(71) Applicant: LG Electronics Inc., Seoul (KR)

(72) Inventors: Kyeonghwan Kim, Seoul (KR); Sungryong Kim, Seoul (KR); Jaehyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 168 days.

(21) Appl. No.: 14/661,547

(22) Filed: Mar. 18, 2015

(65) Prior Publication Data

US 2015/0354123 A1 Dec. 10, 2015

(30) Foreign Application Priority Data

Jun. 9, 2014 (KR) ..... 10-2014-0069245
Jun. 9, 2014 (KR) ..... 10-2014-0069246

(51) Int. Cl.
*D06F 37/22* (2006.01)

(52) U.S. Cl.
CPC ..... *D06F 37/225* (2013.01)

(58) Field of Classification Search
CPC ... D06F 37/203; D06F 37/225; D06F 2222/00
See application file for complete search history.

(56) References Cited

U.S. PATENT DOCUMENTS 4,117,742 A * 10/1978 Stein ..... F01D 5/10 368/171
5,813,253 A 9/1998 Uhlin
2012/0192362 A1 8/2012 Lee et al.
2012/0278996 A1* 11/2012 Park ..... D06F 33/02 8/137
2013/0327098 A1* 12/2013 Bae ..... D06F 37/203 68/13 R
2013/0327099 A1* 12/2013 Bae ..... F16F 7/1011 68/13 R

FOREIGN PATENT DOCUMENTS

| | | | |
|---|---|---|---|
| CN | 202203363 | U | 4/2012 |
| EP | 1045170 | A1 | 10/2000 |
| JP | 2005-054897 | A | 3/2005 |
| JP | 4248965 | A | 3/2005 |
| KR | 10-2013-0114482 | A | 10/2013 |
| KR | 10-2013-0137528 | A | 12/2013 |
| WO | 2013-154313 | A1 | 10/2013 |

OTHER PUBLICATIONS

Machine translation of KR 10-2013-0114482, no date.*

* cited by examiner

*Primary Examiner* — Joseph L Perrin
(74) *Attorney, Agent, or Firm* — Dentons US LLP

(57) ABSTRACT

A laundry machine including a cabinet forming an exterior appearance of the laundry machine, a tub provided inside the cabinet, a drum rotatably provided inside the tub, a balancer housing coupled to a front portion or a back portion of the drum, and a balancing unit movably formed inside the balancer housing in order to reduce an eccentric rotation of the drum. The balancing unit further including a body forming an exterior of the balancing unit, and the body including a first mass body on one lateral side of the body, and a first wheel on another lateral side of the body and configured to roll within the balancer housing, and an elastic member provided between the first mass body and the first wheel, so as to push the first mass body and the first wheel to both lateral sides of the body.

18 Claims, 11 Drawing Sheets

(a)

(b)

(c)

LAUNDRY MACHINE

Pursuant to 35 U.S.C. §119(a), this application claims the benefit of Korean Patent Application Nos. 10-2014-0069245 and 10-2014-0069246, both filed on Jun. 9, 2014, both which are hereby incorporated by reference as if fully set forth herein.

BACKGROUND

Field

The present disclosure relates to a laundry machine. More particularly, the present disclosure relates to a laundry machine that is equipped with a balancing unit that can be actively controlled.

Discussion of the Related Art

Generally, a laundry machine (or washing machine) treats laundry that is to be washed by rotating a drum that contains (or accommodates) the laundry. However, vibration and noise may occur in the laundry machine because of the rotation movements of the drum. Vibration and noise of the laundry machine may be higher during processes, such as spin dry, wherein the drum is rotated at a high speed.

In order to reduce such vibration and noise occurring in the laundry machine, balancing devices are positioned to allow a plurality of balls to move along an outer circumferential surface of the drum in the laundry machine.

Since such plurality of balls move actively based on the rotation of the drum, a problem exists in that a relatively long period of time is consumed to establish the balancing of the drum.

Additionally, when vibration and noise occur in the laundry machine due to a change in a rotation speed of the drum and a change in position of the laundry within the drum, a problem exists in that a relatively long period of time is consumed before the balls fully move (or flow) to establish balancing of the drum.

Furthermore, when the balls of the drum move (or flow) to establish balancing of the drum, the balls may not always be located in accurate positions for establishing balancing of the drum.

SUMMARY

Accordingly, embodiments of the present invention are directed to a laundry machine that substantially obviates one or more problems due to limitations and disadvantages of the related art.

An object is to provide a laundry machine being equipped with a balancing unit that can have its movements actively controlled.

Another object is to provide a laundry machine that can prevent or at least minimize interference, which is caused between a driving gear being equipped in the balancing unit and gear teeth being provided in a balancer housing, when positioning the balancing unit in the balancer housing.

Additional advantages, objects, and features will be set forth in part in the description which follows and in part will become apparent to those having ordinary skill in the art upon examination of the following or may be learned from practice of the invention. The objectives and other advantages may be realized and attained by the structure particularly pointed out in the written description and claims hereof as well as the appended drawings.

To achieve these objects and other advantages and in accordance with the purpose of the invention, as embodied and broadly described herein, a laundry machine includes a cabinet forming an exterior appearance of the laundry machine, a tub provided inside the cabinet, a drum rotatably provided inside the tub, a balancer housing coupled to a front portion or a back portion of the drum, and a balancing unit movably formed inside the balancer housing. The balancing unit may include a body forming an exterior of the balancing unit, and an interior of the body may be provided with a first mass body on one lateral side of the body, and a first wheel on another lateral side of the body and configured to roll within the balancer housing, and an elastic member may be provided between the first mass body and the first wheel, so as to push the first mass body and the first wheel to both lateral sides of the body.

Additionally, a first supporting member rotatably supporting the first wheel may be provided in the body, and each end portion of the elastic member may be respectively installed on the first mass body and the first supporting member.

Additionally, in the body of the balancing unit, a protrusion being protruded towards an inner circumferential surface of the balancer housing may be formed on the lateral side of the body being provided with the first mass body.

Additionally, a first cutout section may be formed on a first horizontal end portion of the body, and a first mass body may be provided on one lateral side of the body based upon the first cutout section and a first wheel is provided on another lateral side of the body.

Additionally, a second cutout section may be formed on a second horizontal end portion of the body, and a second mass body may be provided on one lateral side of the body based upon the second cutout section and a second wheel is provided on another lateral side of the body.

Additionally, the body may be provided with a second supporting member rotatably supporting the second wheel.

Additionally, the first cutout section may include a first slit being extended to a predetermined width starting from the first horizontal end portion of the body and toward the second horizontal end portion of the body, and a first elastic hole on one end of the first slit with a width larger than a width of the first slit.

Additionally, the second cutout section may include a second slit being extended to a predetermined width starting from the second horizontal end portion of the body and toward the first horizontal end portion of the body, and a second elastic hole on one end of the second slit with a width larger than a width of the second slit.

Additionally, the balancing unit may further include a driving motor being provided in the second mass body, and a driving gear receiving a driving force from the driving motor.

Additionally, a plurality of gear teeth may be formed along an inner circumferential surface of the balancer housing, and the driving gear interlocks with the gear teeth of the balancer housing.

Additionally, the balancer housing may be provided along an inner circumferential surface or an outer circumferential surface of a front portion of the drum.

Additionally, the first slit and the first elastic hole may pass through the body of the balancing unit along a thickness direction.

Additionally, the second slit and the second elastic hole may pass through the body of the balancing unit along a thickness direction.

Additionally, the balancing unit may further include one or more gears between the driving motor and the driving gear in order to deliver a driving force supplied by the driving motor to the driving gear.

Additionally, an opening may be formed on one side surface of the body, and the driving gear may be exposed to an outside of the body through the opening.

Additionally, one or more first coils may be provided on an outer circumference of the tub relative to the balancer housing provided along the outer circumference of the drum, the balancing unit may be provided with a second coil, and, when the balancing unit passes a location where one of the one or more first coils is positioned based upon the rotation of the drum, a controller provided in the laundry machine may detect a difference in voltage measured from the first coil, thereby determining a location of the balancing unit.

At this point, the one or more first coils may be supplied with a pre-decided voltage from an external power source, and, when the balancing unit passes a location where one of the one or more first coils is located, an electric current may be generated in a second coil due to an electromagnetic field of the first coil, thereby causing the voltage being supplied to the first coil to be greater than the pre-decided voltage.

Conversely, one or more first coils may be provided on an external circumference of the tub relative to the balancer housing being provided along an external circumference of the drum, the balancing unit may be provided with a second coil, and, when the balancing unit actively moves within the balancer housing and passes a location where one of the one or more first coils is located, a controller provided in the laundry machine may detect a difference in voltage measured from the first coil, thereby determining a location of the balancing unit.

At this point, the one or more first coils may be supplied with a pre-decided voltage from an external power source, and, when the balancing unit passes a location where one of the one or more first coils is located, an electric current may be generated in a second coil due to electromagnetic induction, thereby causing the voltage being supplied to the first coil to be greater than the pre-decided voltage.

The elastic member may correspond to a coil spring, and a first supporting member rotatably supporting the first wheel may be provided in the body, and each end portion of the coil spring may be respectively installed on the first mass body and the first supporting member.

Meanwhile, according to another exemplary embodiment of the present invention, a laundry machine includes a tub provided inside a cabinet, a drum rotatably provided inside the tub, a balancer housing coupled to a front portion or a back portion of the drum, and a balancing unit being provided with a driving motor and a driving gear receiving a driving force from the driving motor and being movably formed inside the balancer housing in order to reduce an eccentric rotation of the drum, wherein gear teeth may be formed along an inner circumferential surface of the balancer housing, and wherein the balancing unit is positioned within the balancer housing, so that the driving gear being exposed to an outside of the body of the balancing unit can be interlocked with the gear teeth.

Additionally, when positioning the balancing unit in the balancer housing, at least one inclination may be formed on each of the plurality of gear teeth in order to prevent interference between the driving gear and the gear teeth.

Additionally, the inclination may be formed on one lateral side toward a cover of the balancer housing.

Additionally, the inclination may include a first inclination, which is formed to reduce a thickness of the gear teeth, which are facing the cover of the balancer housing, as the first inclination approaches a lateral end portion of the gear teeth.

Additionally, a partial flat surface may be formed on a side surface of the gear teeth, and the inclination may further include a second inclination being inclined toward a fore-end of the gear teeth starting from an end portion of the partial flat surface.

Additionally, based upon a central line passing through a lateral direction of the gear teeth, the first inclination may be formed to converge with the central line, as the first inclination approaches the lateral end portion of the gear teeth.

Additionally, when positioning the balancing unit within the balancer housing, the first inclination may perform a function of a guiding surface guiding the driving gear of the balancing unit.

Additionally, the partial flat surface is configured to be inclined at a predetermined inclination angle toward the fore-end of the gear teeth, and wherein the second inclination is configured to be inclined toward the fore-end of the gear teeth at an inclination angle that is greater than the inclination angle of the partial flat surface.

Additionally, when positioning the balancing unit within the balancer housing, the second inclination may perform a function of a guiding surface guiding the driving gear of the balancing unit.

At this point, the driving gear may have a form of a pinion gear, and the plurality of gear teeth may have a form of rack gears or ring gears.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention, and together with the description serve to explain the principles of the invention. In the drawings.

Figure 4:
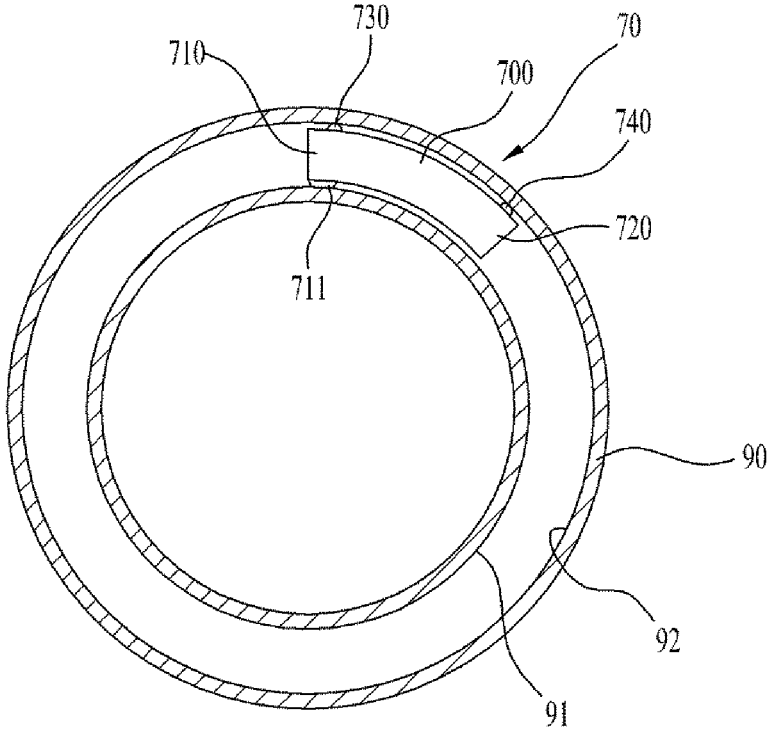
FIG. 4 illustrates a general view of a balancer according to another exemplary embodiment of the present invention.
Figure 5:
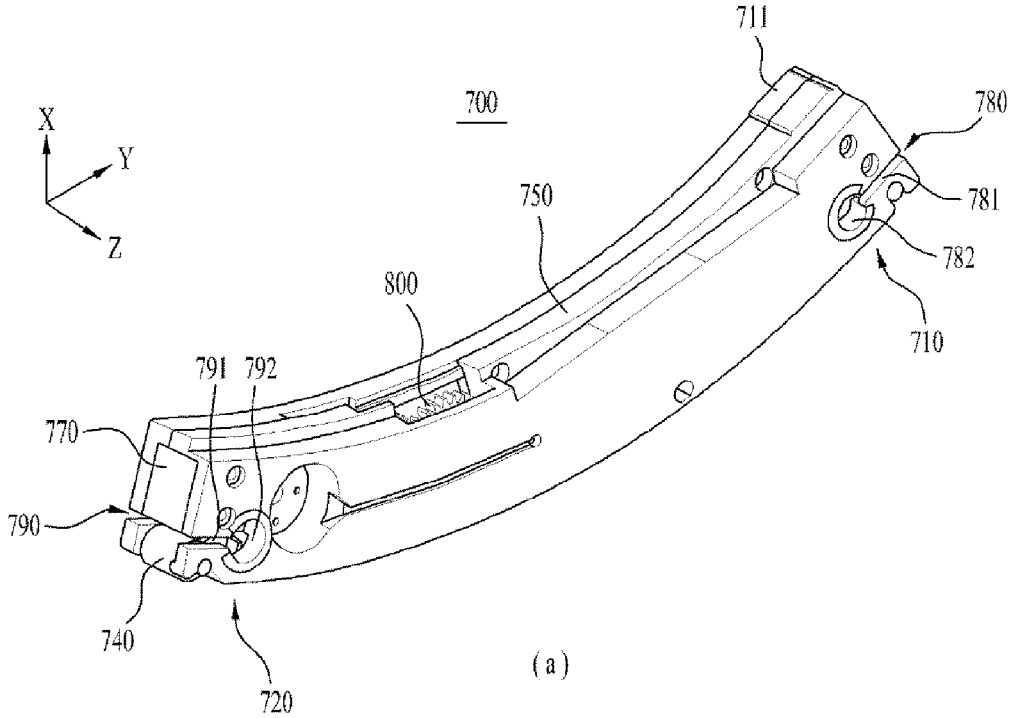
Figure 5:
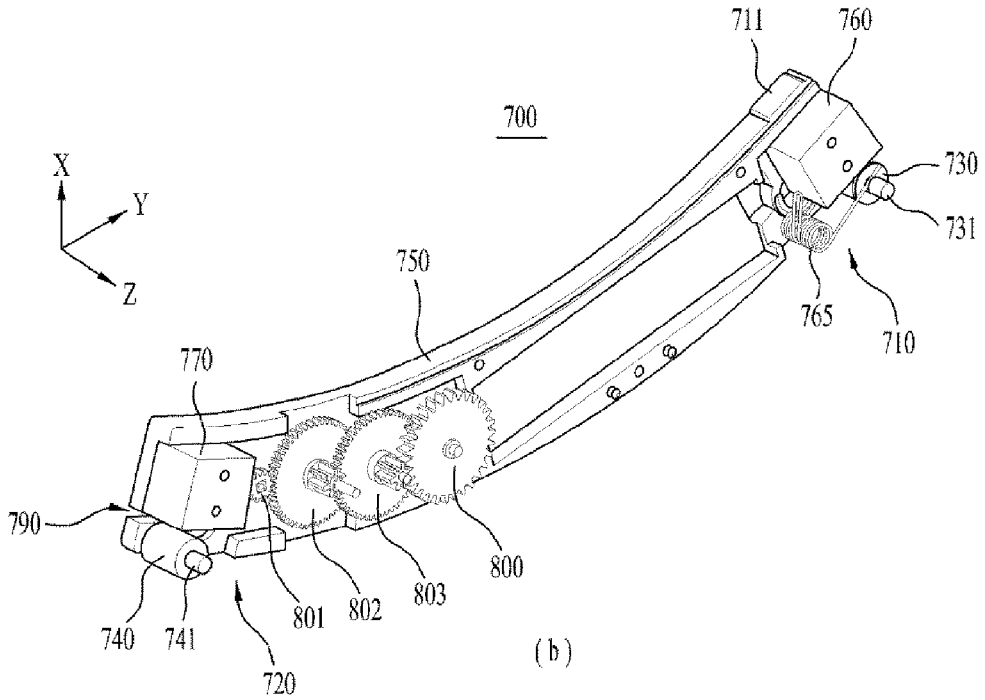
Figure 6:
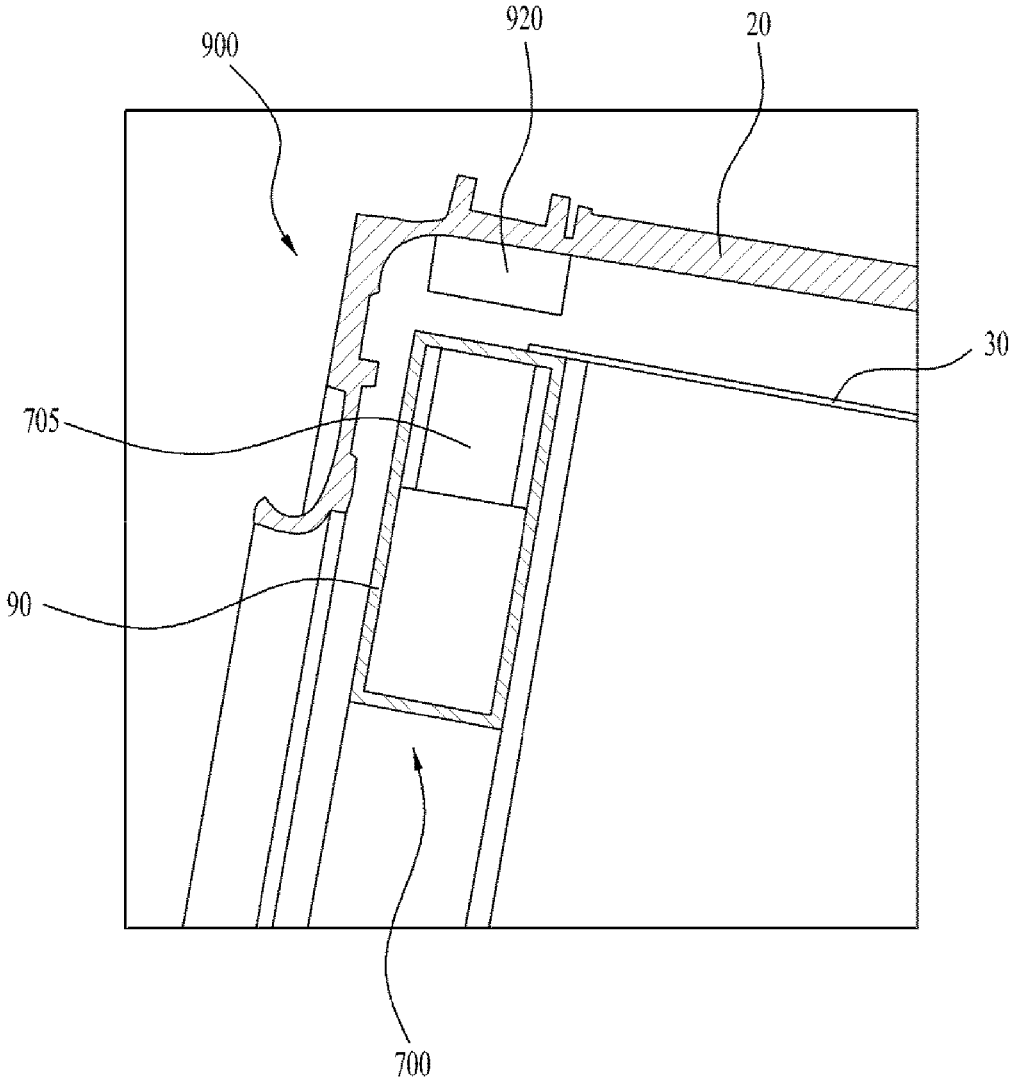
Figure 7:
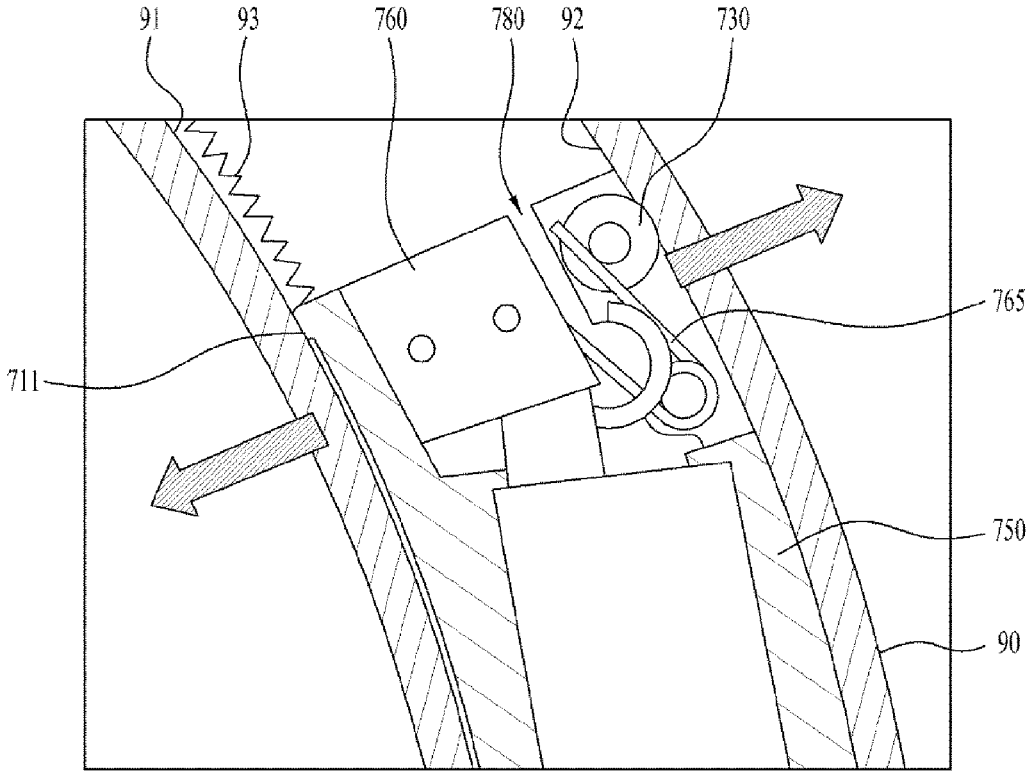
Figure 8:
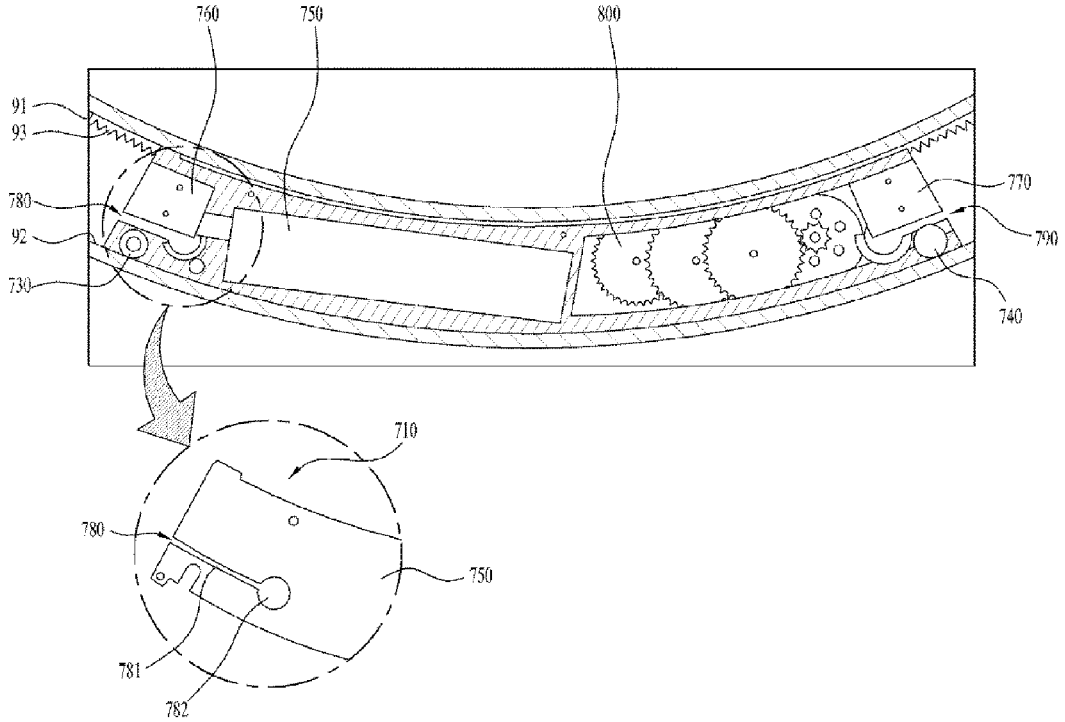
Figure 9:
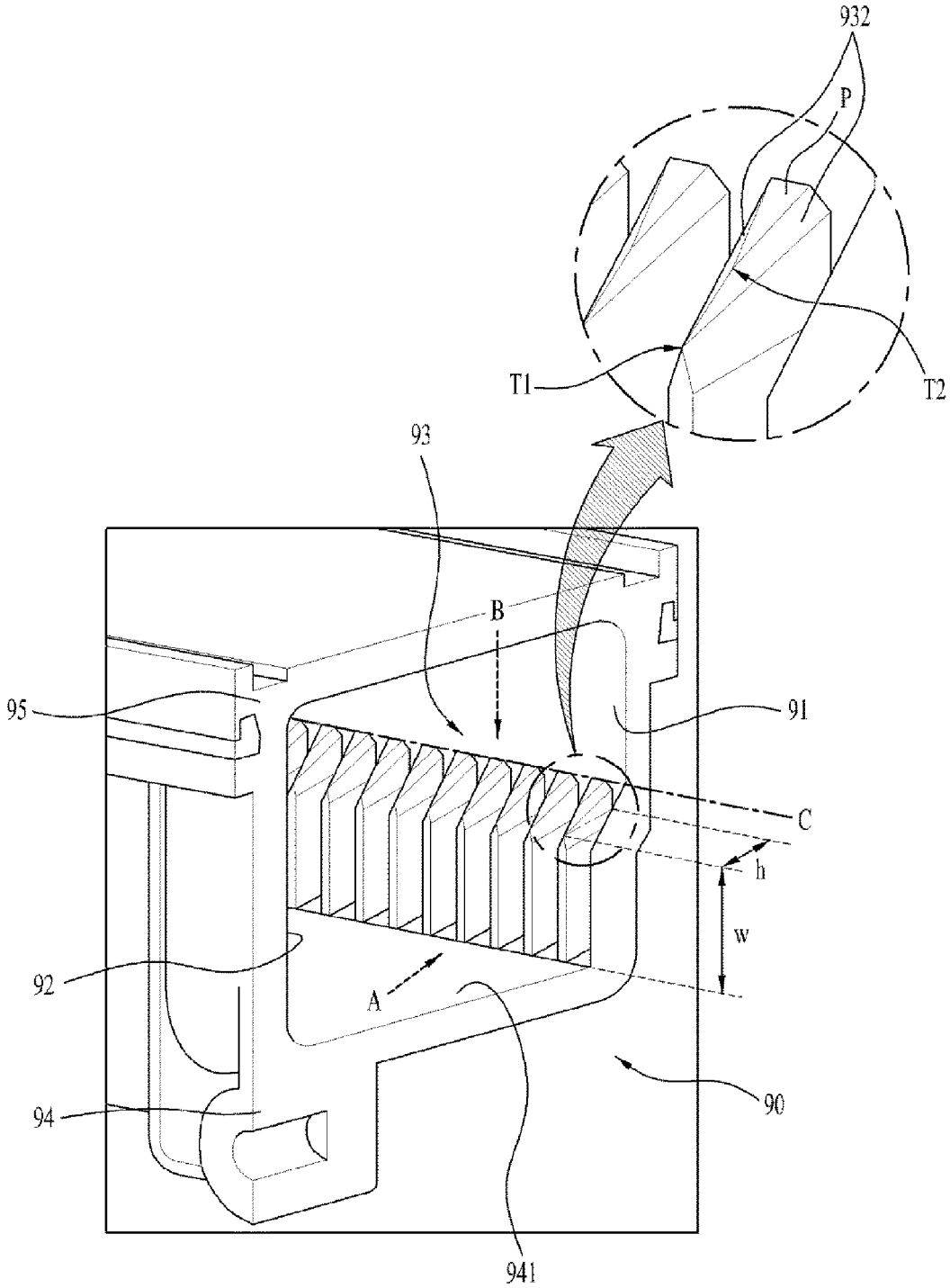
Figure 10:
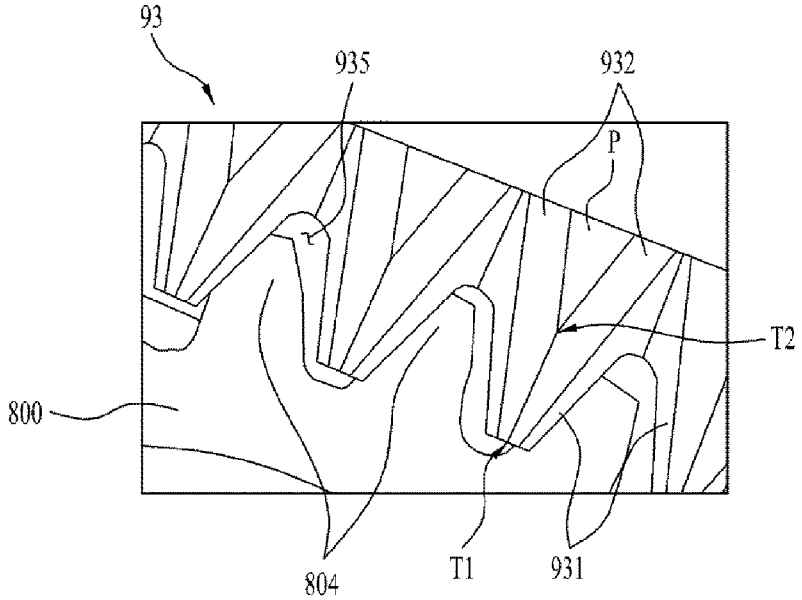
Figure 10:
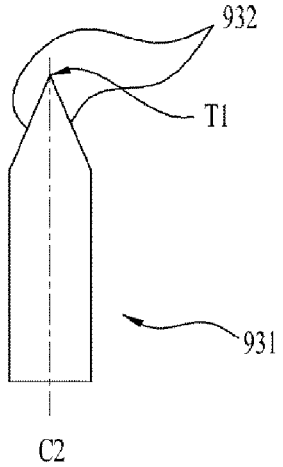
Figure 10:
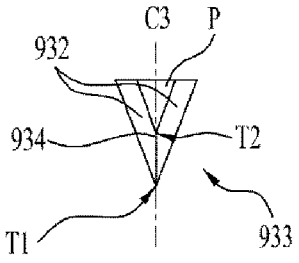
Figure 11:
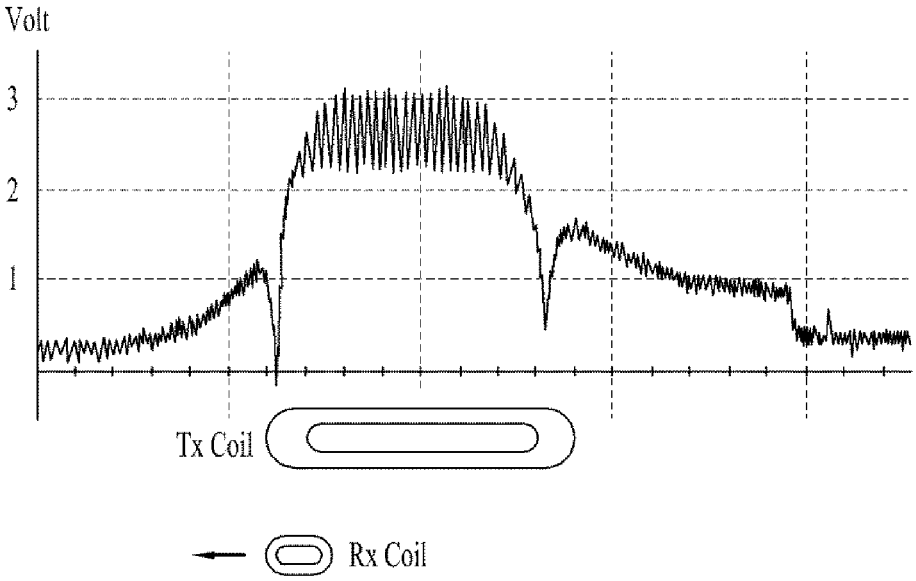

(a) of FIG. 5 illustrates a perspective view of a balancing unit shown in FIG. 4;

(b) of FIG. 5 illustrates a disassembled perspective view of a balancing unit shown in FIG. 4;

FIG. 6 illustrates a general view of a wireless charging device according to an exemplary embodiment of the present invention;

FIG. 7 illustrates an example of a balancing unit shown in FIG. 5 being positioned within a balancer housing, which is provided in a drum, when the drum performs low-speed rotation (or spin);

FIG. 8 illustrates an example of a balancing unit shown in FIG. 5 being positioned within a balancer housing, which is provided in a drum, when the drum performs high-speed rotation (or spin);

FIG. 9 illustrates a cutaway perspective view of the balancer housing being equipped in the drum;

(a) of FIG. 10 illustrates a state when a driving gear is meshed (or interlocked) with gear teeth, which are formed on an inner circumferential surface of the balancer housing;

(b) and (c) of FIG. 10 respectively illustrate general views of the gear teeth, which are formed on the inner circumferential surface of the balancer housing, as shown in FIG. 9, being seen from direction A and direction B; and FIG. 11 illustrates a graph showing a change in voltage being measured from a coil, which is provided on an outer circumferential surface of a tub.

DETAILED DESCRIPTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, the laundry machine according to the exemplary embodiment of the present invention will now be described in detail with reference to the accompanying drawings.

Figure 1:
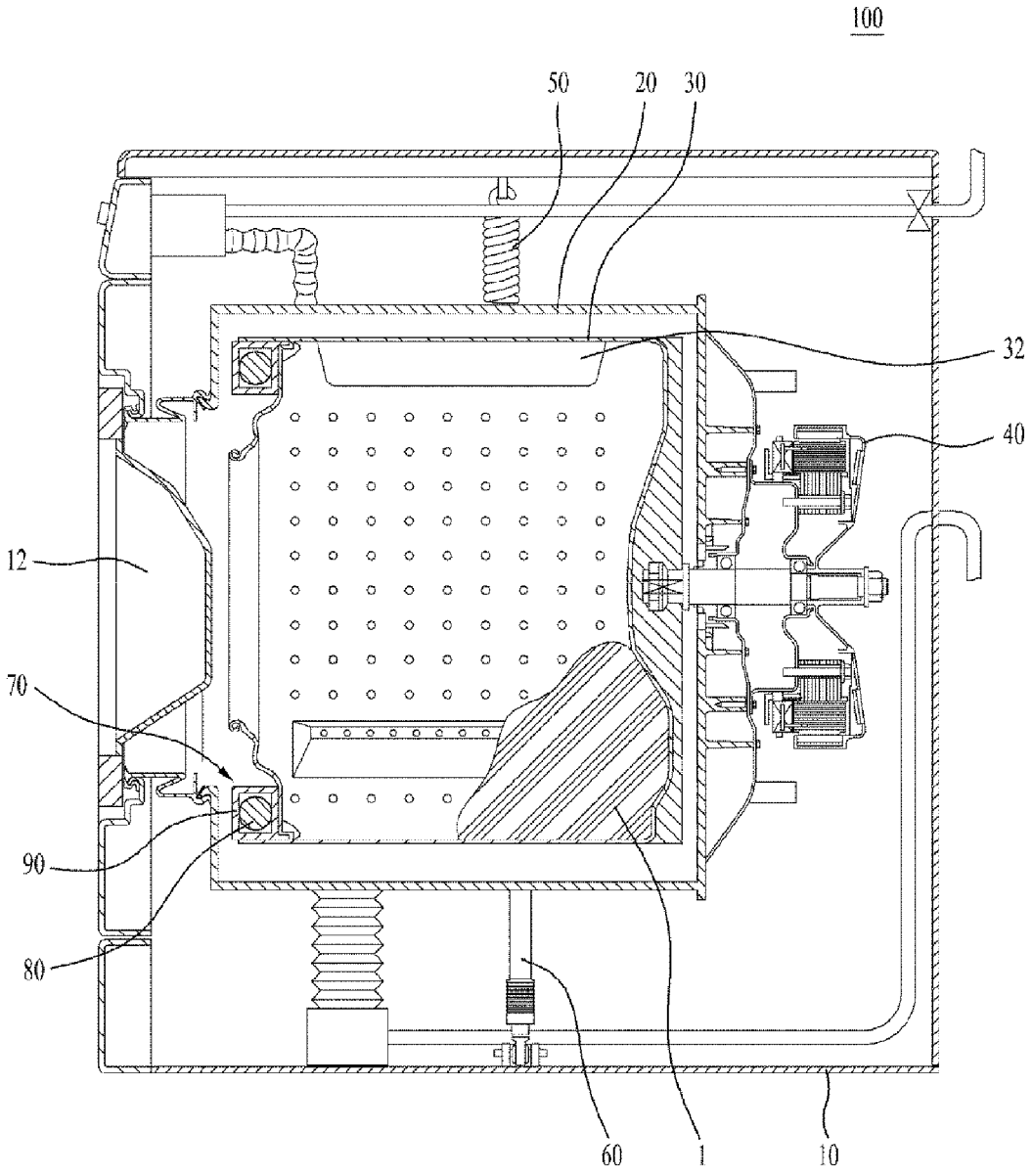
FIG. 1 illustrates a cross-sectional view of a laundry machine being equipped with a ball balancer according to an exemplary embodiment of the present invention.

FIG. 1 illustrates a cross-sectional view of a laundry machine being equipped with a ball balancer.

Referring to FIG. 1, the laundry machine 100 may include a cabinet 10 forming an exterior of the laundry machine 100, a tub 20 being provided inside cabinet 10 and configured to hold washing water, and a drum 30 being equipped in tub 20 so as to perform spinning (or rotating) movements.

Cabinet 10 forms the exterior of laundry machine 100, and diverse assembly parts, which will be described in detail later on, may be coupled to cabinet 10. First, a door 12 may be provided on a front portion of cabinet 10. The user may open door 12 in order to place (or put) laundry inside cabinet 10. More specifically, the user may open door 12, to place laundry that is to be washed inside drum 30.

Tub 20, which is configured to hold washing water, may be provided inside cabinet 10. Drum 30, which is configured to accommodate laundry, may be provided inside tub 20, and rotates (or spins) within tub 20. Additionally, at least one or more lifters 32 may be provided inside drum 30, wherein the one or more lifters 32 lift the laundry upward and then drop the lifted laundry downward when the drum 30 rotates (or spins). A plurality of lifters 32 may be provided herein. It is preferable that three to five lifters 32 are provided inside drum 30.

Meanwhile, tub 20 may be elastically supported within cabinet 10 by a spring 50 formed on tub 20 and a damper 60 formed under tub 20. The vibration that occurs due to the rotation (or spinning) of drum 30 is absorbed by spring 50 and damper 60. Accordingly, the vibration caused by the rotation of drum 30 is not delivered to cabinet 10. Additionally, a driving unit 40, which is configured to rotate drum 30, may be fixed to a rear surface of tub 20. Driving unit 40 may be, for example, a motor, and driving unit 40 may rotate drum 30 using the motor. Since such driving unit 40 is well-known to anyone skilled in the art, detailed description of the same will be omitted for simplicity.

As shown in FIG. 1, in a state when laundry 1 that is to be washed is contained in drum 30, when the drum 30 rotates, noise and vibration may occur in accordance with a position of laundry 1. More specifically, in case laundry 1 is concentrated in a partial area within drum 30 instead of being evenly distributed within the drum 30, when drum 30 performs rotation (hereinafter referred to as 'eccentric rotation'), vibration and noise may more readily occur in drum 30. Accordingly, in order to prevent vibration and noise caused by an eccentric rotation of drum 30 from occurring, drum 30 may be provided with a balancer 70.

Balancer 70 may be provided on at least one of a front portion and a back portion of drum 30. Although it is shown in the drawing that balancer 70 is provided on a front portion of drum 30 for simplicity, the position of balancer 70 will not be so limited.

Meanwhile, since balancer 70 is coupled to the rotating drum 30 in order to prevent noise and vibration from occurring, balancer 70 may be configured to have its center of gravity move variably. More specifically, balancer 70 may include a mass body 80 having a predetermined weight therein. And, balancer 70 may be configured to include a path in which mass body 80 can along a circumferential direction of the drum 30. Accordingly, in case the load of the laundry 1 is concentrated on one side of drum 30, mass body 80, which is provided within balancer 70, moves to an opposite side of the concentrated laundry load, so as to evenly distribute the overall load, thereby preventing noise and vibration from occurring due to the eccentric rotation of drum 30.

Herein, balancer 70 may internally be configured of a liquid balancer including liquid having a predetermined weight or a ball balancer including a ball having a predetermined weight. In the laundry machine according to the exemplary embodiment of the present invention, balancer 70 may internally include one or more balls 80 along with a charging fluid. Additionally, balancer 70 may further include a balancer housing 90, which forms a flow path (or travel path) of the balls 80 along an inner circumferential surface or outer circumferential surface of drum 30. More specifically, balancer housing 90 may be provided along the inner circumferential surface or outer circumferential surface of drum 30, and balls 80 may move (or flow) within balancer housing 90.

Figure 2:
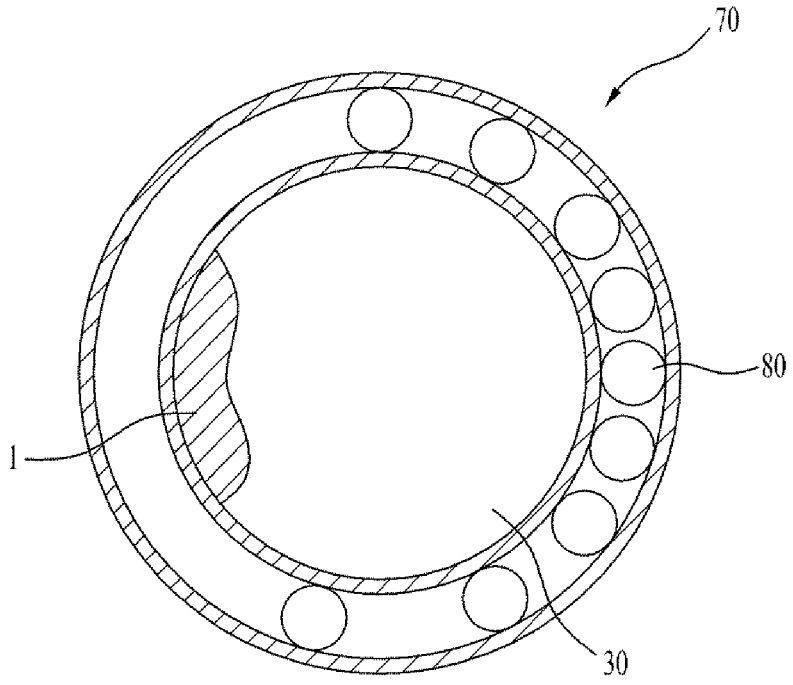
FIG. 2 illustrates a general view showing the ball balancer of FIG. 1 being in an instable state.
Figure 3:
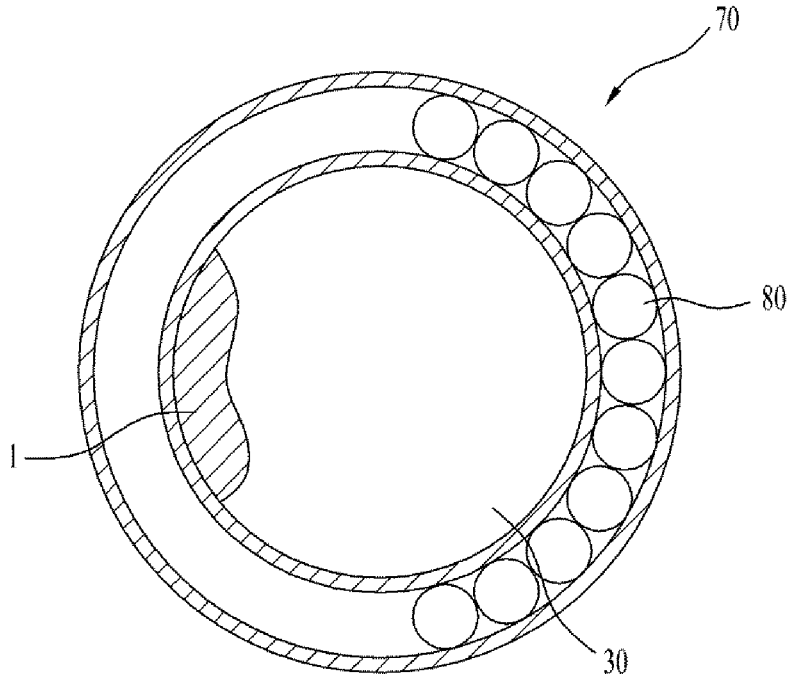
FIG. 3 illustrates a general view showing the ball balancer of FIG. 1 being in a stabilized state.

FIG. 2 and FIG. 3 illustrate a movement (or flow) of balls 80 within balancer 70 during the spinning (or rotation) of the drum.

As shown in FIG. 2, when drum 30 rotates, balls 80 provided in the balancer housing of balancer 70 may gradually begin to move (or flow) towards an opposite side of the laundry 1 within drum 30. After an elapse of a predetermined period of time starting from the initiation of the movement of the balls 80, most of the balls 80 are substantially positioned at the opposite side of the laundry 1, as shown in FIG. 3. More specifically, when laundry 1 is concentrated on a partial area within drum 30, eccentricity may occur when drum 30 rotates (i.e., drum 30 may perform eccentric rotation). At this point, by allowing balls 80 of balancer 70 to be located on the opposite side of laundry 1, the eccentricity may be compensated (or corrected). For example, when drum 30 rotates at a high speed, by allowing balls 80 to be gathered at the opposite side of a region where laundry 1 is concentrated, the eccentric rotation of drum 30 may be prevented, and noise and vibration caused by such eccentric rotation of drum 30 may be prevented.

FIG. 4 illustrates a general view of a balancer 70 according to another exemplary embodiment of the present invention.

Referring to FIG. 4, balancer 70 according to the exemplary embodiment may include a balancer housing 90, which is provided on an inner circumferential surface or outer circumferential surface of drum 30, and a balancing unit 700, which is installed within the balancer housing 90. Balancing unit 700 of FIG. 4 may move within balancer housing 90, and the movement of balancing unit 700 may be actively controlled.

The principle of allowing the balancing unit 700 to move to the opposite side of laundry 1, when laundry 1 is concentrated to a specific area within drum 30, is identical to the description of FIG. 1 to FIG. 3. However, in the exemplary embodiment of FIG. 1, balls 80 are configured to passively move within balancer housing 90 in accordance with the rotation of drum 30, whereas, in the exemplary embodiment of FIG. 4, balancing unit 700 may be actively moved to a desired position within balancer housing 90. Such active control of balancing unit 700 may be performed by a controller (not shown), which is provided in the laundry machine, and a driving motor and a driving gear, which will be described in more detail below.

An inner circumferential surface is provided inside balancer housing 90. The inner circumferential surface of the balancer housing 90 is divided into a first inner circumferential surface 91 and a second inner circumferential surface 92 facing into the first inner circumferential surface 91. Herein, a diameter of the first inner circumferential surface 91 is smaller than a diameter of the second inner circumferential surface 92. Accordingly, a space in which balancing unit 700 can move (or flow) may be formed between the first inner circumferential surface 91 and the second inner circumferential surface 92 of balancer housing 90.

Balancing unit 700 may be configured to have a predecided length. Both horizontal end portions 710 and 720 of the balancing unit 700 may be respectively provided with wheels 730 and 740, which are each configured to roll over the inner circumferential surface (e.g., the first inner circumferential surface) of balancer housing 90. Additionally, one horizontal end portion 710 of balancing unit 700 may be provided with a stopper 711, which is protruded toward the inner circumferential surface (e.g., second inner circumferential surface) of balancer housing 90. Stopper 711 can fix balancing unit 700 to a predetermined location within balancer housing 90. Hereinafter, the balancing unit according to the exemplary embodiment shown in FIG. 4 will be described in more detail with reference to FIG. 5 to FIG. 7.

(a) of FIG. 5 illustrates a perspective view of a balancing unit shown in FIG. 4, and (b) of FIG. 5 illustrates a disassembled perspective view of a balancing unit shown in FIG. 4. Hereinafter, in order to simplify the understanding of the present invention, an X-axis direction, a Y-axis direction, and a Z-axis direction shown in the drawings will be respectively defined as a lateral direction, a horizontal direction (or longitudinal direction), and a vertical direction (or thickness direction) of the balancing unit (i.e., body of the balancing unit).

Referring to (a) and (b) of FIG. 5, balancing unit 700 according to the exemplary embodiment of the present invention includes body 750 forming the exterior of balancing unit 700. Body 750 is configured to have a predetermined length, and to have a curved form, so that the body 750 can be installed inside of balancer housing 90, which is provided along a circumference (inner circumference or outer circumference) of drum 30. More specifically, balancer housing 90, which is provided along the circumference of drum 30, may be configured to have a curvature radius that is identical to a curvature radius of the circumference of drum 30. Therefore, in order to install (or position) body 750 of balancing unit 700 inside of balancer housing 90, it will be preferable for body 750 to also be configured to have a curved form having a predetermined curvature radius. For example, body 750 may be configured to have a curvature radius that is larger than the curvature radius of balancer housing 90. More specifically, body 750 may be configured to have a curved form that is smoother than that of balancer housing 90.

Inside body 750 may be equipped with a first mass body 760 on a lateral side of the body 750 and a first wheel 730, which is provided on another lateral side of the body 750 so as to roll over the inner circumferential surface of balancer housing 90. Additionally, an elastic member 765 may be provided between the first mass body 760 and the first wheel 730. Accordingly, elastic member 765 may push the first mass body 760 and the first wheel 730 to both lateral sides of body 750, so as to fix body 750 of balancing unit 700 to a predetermined location within balancer housing 90. For example, elastic member 765 may correspond to a coil spring, and both end portions of the coil spring may be installed between the first mass body 760 and the first wheel 730, so that the coil spring can push the first mass body 760 and the first wheel 730 to both lateral sides of body 750.

A first supporting member 731, which is configured to rotatably support the first wheel 730, is provided in body 750 of balancing unit 700. At this point, both end portions of the coil spring may be respectively installed on the first mass body 760 and the first wheel 730. Additionally, in body 750 of balancing unit 700, a protrusion 711, which is protruded toward an inner circumferential surface (i.e., first inner circumferential surface or second inner circumferential surface) of balancer housing 90, is provided on a side surface where the first mass body 760 is provided. For example, as shown in FIG. 5, protrusion 711 may be formed on an upper side along the lateral direction of body 750. Such protrusion 711 may perform the function of a stopper, which fixes balancing unit 700 to a predetermined location (or position) within balancer housing 90. More specifically, when the coil spring pushes the first mass body 760 and the first wheel 730 to both lateral sides of body 750, the protrusion 711 formed on the first mass body 760 may contact the inner circumferential surface (i.e., first inner circumferential surface) of balancer housing 90, thereby fixing the position of the balancing unit 700.

Meanwhile, a hollow (or concave) first cutout section 780 is formed on a horizontal end portion 710 of body 750 toward another horizontal end portion 720 located on an opposite side of body 750. At this point, based upon the first cutout section 780, the first mass body 760 may be provided on a lateral side of body 750, and the first wheel 730 may be provided on another lateral side of body 750. For example, based upon the first cutout section 780, the first mass body 760 may be provided on an upper lateral side of body 750, and the first wheel 730 may be provided on a lower lateral side of body 750. Since an elastic member (i.e., coil spring) is installed between the first mass body 760 and the first wheel 730, so as to push the first mass body 760 and the first wheel 730 to both lateral end portions of body 750, protrusion 711 formed on body 750 may fix a position of balancing unit 700 by contacting the inner circumferential surface (i.e., first inner circumferential surface) of balancer housing 90.

Additionally, a hollow (or concave) second cutout section 790 may be formed on another horizontal end portion 720 of body 750 toward the horizontal end portion 710 of body 750. At this point, based upon the second cutout section 790, a second mass body 770 may be provided on a lateral side of body 750, and a second wheel 740 may be provided on a lateral side of body 750. Additionally, a second supporting member 741, which is configured to rotatably support the second wheel 740, is provided in body 750 of balancing unit 700.

At this point, the first cutout section 780 may include a first slit 781, which is extended to have a predetermined width starting from the horizontal end portion 710 of body 750 toward the other end portion 720 of body 750, and a first elastic hole 782, which is formed on an end portion of the first slit 781 and configured to have a width larger that the width of the first slit 781. Additionally, the second cutout section 790 may also include a second slit 791, which is extended to have a predetermined width starting from the horizontal end portion 710 of body 750 toward the other end portion 720 of body 750, and a second elastic hole 792, which is formed on an end portion of the second slit 791 and configured to have a width larger that the width of the second slit 791. At this point, the first slit 781, the first elastic hole 782, the second slit 791, and the second elastic hole 792 may be configured to pass through body 750 of balancing unit 700 along a vertical direction (or thickness) of the body 750.

As described above, since the first slit 781 and the second slit 791 are respectively formed on each end portion of body 750, the width of both end portions of body 750 may be reduced as much as the width of the first slit 781 and the second slit 791 by an external force. Although it will be described in more detail later on, in case the width of both end portions of body 750 is reduced as much as the width of the first slit 781 and the second slit 791, a curvature radius of body 750 may become identical to the curvature radius of balancer housing 90, and a lateral side surface of body 750 may establish surface contact with the inner circumferential surface (i.e., second inner circumferential surface) of balancer housing 90.

Balancing unit 700 may further include a driving motor (not shown), which is being provided inside the second mass body 770, and a driving gear 800, which rotates by receiving a driving force from the driving motor. Additionally, a plurality of gear teeth 93 may be formed along the inner circumferential surface of the balancer housing 90 (see FIG. 6 to FIG. 8). And, driving gear 800 may be formed to be meshed (or interlocked) with gear teeth 93 of balancer housing 90. In order to allow driving gear 800, which is installed inside body 750 of balancing unit 700, to be interlocked with gear teeth 93 formed in balancer housing 90, at least a portion of the driving gear 800 is exposed to an outside of body 750 through an opening 751 formed on body 750. More specifically, opening 751 is formed on a predetermined location of body 750, and a portion of driving gear 800 is exposed through opening 751, so as to allow driving gear 800 to be interlocked with gear teeth 93 formed on balancer housing 90. Accordingly, if the driving force of the driving motor is delivered to driving gear 800, since the driving gear 800 rotates by being interlocked with the gear teeth 93 of balancer housing 90, balancing unit 700 may move inside balancer housing 90.

Meanwhile, in order to deliver the driving force of the driving motor to the driving gear 800, balancing unit 700 may further include one or more gears, which are installed between the driving motor and driving gear 800. In the exemplary embodiment shown in the drawing, a first gear 801, a second gear 802, and a third gear 803 may be installed between the driving motor and the driving gear 800. As the rotation of the driving motor decelerates in accordance with gear ratios of the first gear, the second gear, and the third gear, which are installed between the driving motor and driving gear 800, a rotation torque being delivered to driving gear 800 may be increased. Conversely, as the rotation of the driving motor accelerates in accordance with gear ratios of the first gear, the second gear, and the third gear, the rotation torque being delivered to driving gear 800 may be decreased.

Although it is not shown in the drawing, balancing unit 700 may be provided with a power supply source, such as a dry-cell battery, which is used to supply power to the driving motor. At this point, when a dry-cell battery is used as the power supply source, the configuration of balancing unit 700 may not only become complex but may also cause inconvenience to the user in having to disassemble the balancing unit 700 in order to change the battery, in case the dry-cell battery is discharged (or out of power). Therefore, in the following description, a wireless charging device that can wirelessly recharge the balancing unit will be described in detail.

FIG. 6 illustrates a general view of a wireless charging device according to an exemplary embodiment of the present invention.

Referring to FIG. 6, the wireless charging device 900 may be provided with a magnet 920, which is installed on a predetermined location of tub 20, and a solenoid 705, which is installed on the balancing unit 700 with respect to magnet 920. Accordingly, when the balancing unit 700 rotates, due to an electromagnetic induction between the solenoid 705 and the magnet 920, which is provided in tub 20, a capacitor (or condenser) (not shown) of the balancing unit 700 may be recharged through the solenoid 705. In this case, since magnet 920 is provided in a tub 20, which does not rotate, the recharging may be performed by the rotation of drum 30 or balancing unit 700. In order to perform the rotation movements, balancing unit 700 is fixed to a predetermined location in accordance with balancer housing 90, and, when the drum 30 rotates, the balancing unit 700 may also rotate along with drum 30.

Although it is not shown in the drawing, the above-described magnet and solenoid may be respectively replaced with a first coil and a second coil. More specifically, when the balancing unit 700 rotates, the balancing unit 700 may be recharged by an electromagnetic induction between the first coil and the second coil. Apart from the replacement of the magnet and solenoid of the wireless charging device to the first coil and the second coil, the remaining description is identical to the description provided above with reference to FIG. 6, and, therefore, detailed description of the same will be omitted for simplicity.

As described above, the driving motor (not shown) may be supplied with power from a dry-cell battery or capacitor (or condenser) (both not shown), and movements of balancing unit 700 may be controlled by communication between a controller, which is installed in the laundry machine, and a signal receiver (not shown), which is installed in balancing unit 700. For example, when the controller detects an eccentric rotation of drum 30, the controller may move balancing unit 700 to a direction that can reduce the eccentric rotation of drum 30. More specifically, the controller may move balancing unit 700 to a desired location (or position) within the balancer housing 90 by rotating the driving motor. Herein, the desired location refers to a location that can reduce the eccentric rotation of the drum 30 (i.e., a location opposite to where the laundry is concentrated, as shown in FIG. 3).

FIG. 7 illustrates an example of a balancing unit shown in FIG. 5 being positioned within a balancer housing, which is provided in a drum, when the drum performs low-speed rotation (or spin) (e.g., 0 to 150 RPM).

Even if drum 30 begins to rotate, a pre-decided rotation speed section of drum 30, during which balancing unit 700 is fixed inside balancer housing 90 without sliding, is defined as a "low-speed rotation section (e.g., 0 to 150 RPM)". And, as drum 30 is being rotated, a rotation speed section of drum 30, during which balancing unit 700 can move within balancer housing 90, is defined as an "operable (or ready-to-operate) rotation section (e.g., 150 to 400 RPM)". And, when drum 30 rotates at a pre-decided speed or faster, a rotation speed section of drum 30, during which balancing unit 700 is fixed inside balancer housing 90 without sliding, is defined as a "high-speed rotation section (e.g., 700 RPM or more)". Additionally, the operable rotation section may also be defined as a mid-speed rotation section. As described above, it will be preferable that balancing unit 700 is fixed inside balancer housing 90 during the low-speed rotation section and the high-speed rotation section of drum 30, and it will be preferable that balancing unit 700 is configured to move within balancer housing 90 during the operable rotation section (or mid-speed rotation section) of drum 30.

Referring to FIG. 7, when drum 30 rotates at a low speed (i.e., during the low-speed rotation section), balancing unit 700 shall be fixed to a predetermined location within balancer housing 90, so that balancing unit 700 cannot move within balancer housing 90. In order to fix balancing unit 700 to a predetermined location within balancer housing 90, a protrusion 711 being protruded toward the first inner circumferential surface 91 of balancer housing 90 may be formed on body 750 of balancing unit 700. For example, as shown in FIG. 7, protrusion 711 may be formed on a left lateral side of body 750. Such protrusion 711 may perform the function of a stopper, which fixes balancing unit 700 to a predetermined location within balancer housing 90.

More specifically, based upon the first cutout section 780, when the elastic member (i.e., coil spring) 765 pushes the first mass body 760 and the first wheel 730 to both lateral sides of body 750 (toward directions of arrows shown in FIG. 7), protrusion 711 performing the function of the stopper may contact the first inner circumferential surface 91 of balancer housing 90, thereby fixing the position of balancing unit 700. More specifically, during the low-speed rotation section of drum 30, an elastic force of elastic member 765, which pushes the first mass body 760 and the first wheel 730 to both lateral sides of body 750, may become greater than a centrifugal force received by balancing unit 700 due to the rotation of drum 30. Accordingly, during the low-speed rotation section of drum 30, balancing unit 700 may be fixed to a predetermined location within balancer housing 90.

Meanwhile, during the operable rotation section (or mid-speed rotation section) of drum 30, during which drum 30 rotates at a predetermined rotation speed (e.g., 150 to 400 RPM), balancing unit 700 may be configured to move within balancer housing 90. More specifically, during the operable rotation section of drum 30, due to the rotation of drum 30, a centrifugal force being applied to the balancing unit 700 may become greater than an elastic force of elastic member 765, which pushes the first mass body 760 and the first wheel 730 to both lateral sides of the body 750. Accordingly, during the operable rotation section of drum 30, protrusion 711 performing the function of the stopper may be separated (or detached) from the first inner circumferential surface 91 of balancer housing 90, thereby allowing the balancing unit 700 to move within balancer housing 90. More specifically, in body 750 of balancing unit 700, a first wheel 730 is provided at a location opposite to and facing into protrusion 711. Accordingly, when protrusion 711 performing the function of stopper is separated (or detached) from the first inner circumferential surface 91 of balancer housing 90, first wheel 730 may roll over the second inner circumferential surface 92 of balancer housing 90, thereby allowing balancing unit 700 to move.

Movement of balancing unit 700 may occur as the driving force of the driving motor is being delivered to the driving gear 800 in accordance with a command of the controller (not shown). More specifically, when vibration and noise are likely to be generated due to an eccentric rotation of drum 30, the controller may move balancing unit 700 to a location within balancer housing 90 that can reduce or eliminate the eccentric rotation. More specifically, when drum 30 rotates at a predetermined speed, and when vibration and noise are generated due to an eccentric rotation of drum 30, the controller may compensate for the eccentricity of drum 30, so that the vibration and noise can be eliminated, by moving balancing unit 700. At this point, the controller may control the rotation speed and rotation direction of the driving motor within balancing unit 700. And, in accordance with the driving of the driving motor, balancing unit 700 may move within balancer housing 90.

FIG. 8 illustrates an example of a balancing unit shown in FIG. 5 being positioned within a balancer housing, which is provided in a drum, when the drum performs high-speed rotation (or spin) (e.g., rotation at 700 RPM or more).

During the high-speed rotation section of drum 30, balancing unit 700 shall be fixed to a predetermined location within balancer housing 90. However, due to the rotating force of drum 30, which rotates at a high speed, balancing unit 700 is very likely to slide (or slip) and move within balancer housing 90.

Referring to FIG. 8, in order to allow balancing unit 700 to be positioned within balancer housing 90, which has a predetermined curvature, body 750 of balancing unit 700 may also be configured to have a curved form by having a predetermined curvature. More specifically, body 750 may be configured to have a curvature radius that is larger than the curvature radius of balancer housing 90. More specifically, body 750 may be configured to have a curved form that is smoother than that of balancer housing 90.

Meanwhile, when drum 30 rotates at a high speed, protrusion 711 performing the function of the stopper is separated (or detached) from the first inner circumferential surface 91 of balancer housing 90, thereby being incapable of performing the function of the stopper. However, due to the high-speed rotation speed of drum 30, when balancing unit 700 within balancer housing 90 receives a centrifugal force, based upon the first cutout section 780 and the second cutout section 790 of balancing unit 700, the width of body 750 may be reduced. More specifically, since the cutout section 780 and the second cutout section 790 are respectively formed on both horizontal end portions of balancing unit 700, when drum 30 rotates at a high speed, the widths of both end portions of balancing unit 700 may be reduced based upon the first cutout section 780 and the second cutout section 790.

A centrifugal force, which is received by balancing unit 700 due to the high-speed rotation of drum 30, may become greater than an elastic force of the elastic member 765, which pushes the first mass body 760 and the first wheel 730 to both lateral sides of the body 750. Moreover, since body 750 of balancing unit 700 is also formed of a material having a predetermined elastic force, and since the centrifugal force, which is received by balancing unit 700 due to the high-speed rotation of drum 30, is greater than the elastic force of body 750, based upon the first cutout section 780 and the second cutout section 790, the width of body 750 may be reduced as much as the widths of the first cutout section 780 and the second cutout section 790.

At this point, when the widths of both horizontal end portions of body 750 are reduced based upon the first cutout section 780 and the second cutout section 790, the form of body 750 of balancing unit 700 is modified. More specifically, when the widths of both horizontal end portions of balancing unit 700 are reduced, the curvature radius of body 750 of balancing unit 700 is also reduced. For example, body 750 of balancing unit 700, which receives the centrifugal force caused by the high-speed rotation of drum 30, is modified to a more curved form as compared to the form prior to receiving the centrifugal force. At this point, the curvature radius of body 750 of balancing unit 700 may be configured to be identical to the curvature radius of balancer housing 90.

As described above, when drum 30 rotates at a high speed, a side surface of body 750 of balancing unit 700, which faces into the second inner circumferential surface 92 of balancer housing 90, establishes surface contact with the second inner circumferential surface 92 of balancer housing 90. At this point, the side surface of body 750 of balancing unit 700, which faces into the second inner circumferential surface 92 of balancer housing 90, may perform the function of the stopper, thereby being capable of fixing balancing unit 700 to a predetermined location within balancer housing 90.

More specifically, due to the high-speed rotation of drum 30, the widths of both horizontal end portions of body 750 of balancing unit 700 are reduced, thereby allowing the curvature radius of body 750 of balancing unit 700 to be identical to the curvature radius of balancer housing 90. Additionally, due to the centrifugal force generated by the high-speed rotation of drum 30, a side surface of body 750 of balancing unit 700 (i.e., a side surface of body 750 facing into the second inner circumferential surface 92 of balancer housing 90) establishes surface contact with the second inner circumferential surface 92 of balancer housing 90, thereby allowing balancing unit 700 to be fixed to a predetermined location within balancer housing 90.

FIG. 9 illustrates a cutaway perspective view of the balancer housing being equipped in the drum. And, as a state when a driving gear is meshed (or interlocked) with gear teeth, which are formed on an inner circumferential surface of the balancer housing, (a) of FIG. 10 illustrates a state seen from direction B of FIG. 9. And, (b) and (c) of FIG. 10 respectively illustrate general views of the gear teeth, which are formed on the inner circumferential surface of the balancer housing, as shown in FIG. 9, being seen from direction A and direction B.

Hereinafter, referring to FIG. 9 and (a) through (c) of FIG. 10, when positioning balancing unit 700 within balancer housing 90, a state when the driving gear 800 of balancing unit 700 is interlocked with the gear teeth 93 formed on the inner circumferential surface of balancer housing 90 will be described in detail. At this point, the driving gear 800 may be configured to have a form of a pinion gear, and the plurality of gear teeth 93 formed on the inner circumferential surface of the balancer housing 90 may each be formed to have a form of a rack gear or a ring gear.

In order to accommodate (or contain) balancing unit 700, the balancer housing 90, which is provided on the front portion of drum 30, may consist of a balancer housing base 94 and a balancer housing cover 95, which are detachably coupled to one another. More specifically, balancer housing base 94 and balancer housing cover 95 are coupled so as to form balancer housing 90.

Additionally, a first inner circumferential surface 91 and a second inner circumferential surface 92 facing into the first inner circumferential surface 91 are formed inside the balancer housing base 94, and gear teeth 93 are formed on at least one portion of the first inner circumferential surface 91. For example, the first inner circumferential surface 91 may be divided into one side and another side based upon a circumferential central line C1 as the respective boundary, and the gear teeth 93 may be formed on one side (low side of the central line C1 shown in FIG. 9) of the first inner circumferential surface 91.

At this point, the gear teeth 93 may be formed as a single body with the first inner circumferential surface 91 or may separately fabricated and installed on the first inner circumferential surface 91. More specifically, after fabricating the gear teeth 93 to have a rack gear form or a ring gear form, such rack gears or ring gears may be installed along the first inner circumferential surface 91 of the balancer housing base 94.

In order to position balancing unit 700 within balancer housing 90, the balancer housing cover 95 shall be separated (or detached) from the balancer housing base 94. More specifically, after the balancer housing cover 95 is detached from the balancer housing base 94, balancing unit 700 may be installed in the balancer housing base 94 along direction B shown in FIG. 9. Additionally, after balancing unit 700 is installed in the balancer housing base 94, the balancer housing base 94 may be covered by the balancer housing cover 95, so that balancing unit 700 can be accommodated (or contained) in balancer housing 90.

Meanwhile, at least a portion of the driving gear 800 of balancing unit 700 is exposed to the outside of body 750 of balancing unit 700 in order to be interlocked with the gear teeth 93, which are formed inside balancer housing 90. Accordingly, when installing balancing unit 700 inside the balancer housing base 94, interference may be generated between a side surface of the driving gear 800 and each one side surface of the gear teeth 93. Therefore, in order to facilitate the installation of balancing unit 700 within the balancer housing base 94, inclinations 932 and 934 being inclined to a predetermined inclination angle may be formed on the gear teeth 93, which are formed inside balancer housing 90. Hereinafter, the inclinations 932 and 934 will be described in more detail.

In order to facilitate the understanding of the present invention, a portion of the gear teeth 93 seen from direction A of FIG. 9 is defined as a "fore-end part 931 of gear teeth 93", and a portion of the gear teeth 93 seen from direction B of FIG. 9 is defined as a "side surface part 933 of gear teeth 93". Additionally, a level of protrusion of the gear teeth 93 being protruded from the first inner circumferential surface 91 of the balancer housing 90 is defined as a height direction (or vertical direction) h of gear teeth 93, and a level of protrusion of gear teeth 93 being protruded from base 94 of the balancer housing 90 toward the balancer housing cover 95 is defined as a width direction w of the gear teeth. Furthermore, the fore-end part 931 of the gear teeth 93 is perpendicular to the side surface part 933 of the gear teeth 93.

The fore-end part 931 of gear teeth 93 is configured to be interlocked with the driving gear 800 of balancing unit 700. When seen from direction A of FIG. 9, at least two first inclinations 932 may be formed on one width direction w side of a gear tooth 93 based upon a central line C2, which passes through the gear teeth 93 along the width direction w (see FIG. 9 and (b) and (c) of FIG. 10). For example, the first inclination 932 being configured to have a predetermined inclination angle may be formed on one width direction w side of a gear tooth 93, which is facing into the cover 95 of balancer housing 90. Additionally, the first inclination 932 is preferably formed to become narrower as it approaches the central line C2. More specifically, the first inclination 932 may be formed on one width direction w side part of a gear tooth 93, which is facing into the balancer housing cover 95.

The first inclination 932 is configured to have a thickness of the gear tooth 93 become narrower as it approaches an end portion of the width direction w of the gear teeth 93 facing into the balancer housing cover 95. For example, (b) of FIG. 10 illustrates an exemplary view of a fore-end part 931 of the gear teeth 93. And, herein, a first inclination 932 may be formed on a width direction w side portion of the fore-end part 931 of the gear teeth 93, which are protruded from the base 94 of balancer housing 90. Even more specifically, the first inclination 932 may be formed to converge with the central line C2 as it approaches a side surface part 933 of the gear teeth 93.

Referring to FIG. 9 and (b) of FIG. 10, the first inclination 932 is illustrated as being formed on an upper portion of the fore-end part 931. More specifically, based upon a central line C2, which passes through the fore-end part 931 along a vertical direction of the gear tooth 93, the first inclination 932 may be formed so that both sides of the central line C2 has an inclination toward the central line C2.

Therefore, when positioning balancing unit 700 in the balancer housing base 94 after opening the balancer housing cover 95, a side surface of the driving gear 800, which is provided in balancing unit 700, is guided along the first inclination 932 of the gear tooth 93, thereby allowing the driving gear 800 to be easily interlocked with the gear tooth (or teeth) 93.

More specifically, when positioning balancing unit 700 in the balancer housing base 94, interference that may be generated between a side surface of the driving gear 800, which is provided in balancing unit 700, and a side surface part 933 of the gear teeth 93, may be prevented or at least minimized by the first inclination 932.

Evidently, two or more inclinations 932, which are inclined based upon the central line C2, may also be formed on the gear tooth 93. In this case, the first inclination 932 shall be configured to have a larger inclination angle, as the first inclination approaches the width direction w end portion of the gear tooth 93.

Furthermore, since a plurality of gear teeth 93 are configured to have a rack gear form or a ring gear form, and since an inclination 932 is formed on each of the plurality of gear teeth 93, a space 995 between each gear tooth 93 allowing the driving gear 800 to be interlocked with the gear teeth 93 may be sufficiently ensured.

Therefore, after opening the balancer housing cover 95, when balancing unit 700 is installed inside the balancer housing base 94 along direction B of FIG. 9, a side surface of the driving gear 700 (i.e., a side surface of a gear tooth 804 of the driving gear 800) is guided along the first inclination 932 of the gear teeth 93, which are formed or installed on the first inner circumferential surface 91 of balancer housing 90, thereby allowing the driving gear 800 to be easily interlocked with the gear teeth 93. More specifically, by guiding the gear teeth 804 of the driving gear 800 along the first inclination 932 of the gear teeth 93, the gear teeth 804 of the driving gear 800 may be easily positioned in the space 935 formed between each gear tooth 93. As described above, the first inclination 932 performs a function of a guiding surface, which is configured to guide the driving gear 800 of balancing unit 700.

Additionally, when seen from the side surface unit 933 of the gear tooth 93, a partially flat surface P and a second inclination 935, which is inclined starting from an end portion T2 of the partially flat surface P toward a fore-end T1 of the gear tooth 93, may be formed on the side surface of the gear tooth 93. More specifically, when seen from direction B of FIG. 9, a partially flat surface P may be provided on the side surface of the gear tooth 93, as shown in (c) of FIG. 10. At this point, the partially flat surface P may be formed to have a triangular form. Also, the second inclination 934 may be formed toward a tooth top T1 starting from a peak point T2 of the partially flat surface P. More specifically, the second inclination 934 may be formed to be inclined toward the tooth top T1 starting from a vortex T2 of the partially flat surface P, which is inclined toward the tooth top T1, in the triangular partially flat surface P.

For example, when seen from direction B of FIG. 9, the triangular partially flat surface P may be provided on at least a portion of the side surface of the gear tooth 93. Additionally, a central line C3, which passes through the gear tooth 93 along a height direction h (or vertical direction), may be formed to pass through the peak point (or one vortex) T2 of the partially flat surface P. Moreover, the central line C3 not only passes through the peak point T2 of the partially flat surface P but also passes through the tooth top T1 of the gear tooth 93. At this point, the second inclination 935 may be formed starting from the end portion T2 of the partially flat surface P and toward the tooth top T1 of the gear tooth 93.

Additionally, the partially flat surface P itself may be configured to be inclined at a predetermined inclination angle toward the tooth top T1 of the gear tooth 93, and the second inclination 934 may be formed to have an inclination angle that is greater than the inclination angle of the partially flat surface P. More specifically, both the partially flat surface P and the second inclination 934, which is extended from the end portion T2 of the partially flat surface P, may be formed to have an inclination toward the fore-end T1 of all gear teeth 93. At this point, it will be preferable that the inclination angle of the second inclination 934 is formed to be greater than the inclination angle of the partially flat surface P. More specifically, the second inclination 934 may be formed to be inclined at an inclination angle that is greater than the fore-end T1 of the gear tooth 93 as compared to the partially flat surface P.

More specifically, referring to FIG. 9 and (c) of FIG. 10, when seen from direction B of FIG. 9, a partially flat surface P having a triangular form, a first inclination 932 being inclined toward a bottom 941 of the balancer housing base 94 starting from two segments of the triangular partially flat surface P, and a second inclination 934 being inclined toward the tooth top T1 of the gear tooth 93 starting from a peak point T2 of the partially flat surface P.

The first inclination 932 may be configured of two inclined surfaces, and each inclined surface may have its boundary decided (or divided) by the partially flat surface P and the second inclination 934.

Additionally, the second inclination 934 may be configured of a line, which is being extended from the peak point T2 of the triangular partially flat surface P toward the tooth top T1 of the gear tooth 93.

Accordingly, the two inclined surfaces configuring the first inclination 932 are spaced apart from one another to both sides of the central line C3 due to the partially flat surface P. Additionally, the two inclined surfaces of the first inclination 932 may be configured to contact one another at the second inclination 934, which is formed of a line. For example, the first inclination 932 may be configured of two surfaces being extended from the tooth bottom to the tooth top. And, the two extended surfaces may be spaced apart from one another by the partially flat surface P. Furthermore, the two surfaces may be formed to establish line contact within one another at the second inclination 934, which is extended by a line toward the tooth top T1 starting from the peak point T1, which corresponds to an end portion of the partially flat surface P.

Therefore, when balancer housing cover 95 is opened, and when balancing unit 700 is positioned in the balancer housing base 94, so that the driving gear 800 can be interlocked with the gear teeth 93, interference occurring between a side surface of the driving gear 800, which is provided in balancing unit 700, and the side surface unit 933 of the gear tooth 93 may be minimized.

More specifically, when positioning balancing unit 700 within balancer housing 90, the balancer housing cover 95 may be opened, and, then, balancing unit 700 may be installed to face into the balancer housing base 94 having the plurality of gear teeth 93 formed thereon. Additionally, balancing unit 700 shall be positioned inside balancer housing 90, so that the driving gear provided in the balancing unit 700 and the plurality of gear teeth 93 can be interlocked with one another. At this point, the side surface of the driving gear 800 may interfere with the side surface of the gear tooth 93. Such interference between the driving gear 800 and the gear teeth 93 may be eliminated or at least minimized by the above-described first inclination 932 and the second inclination 934.

More specifically, when opening the balancer housing cover 95 and installing balancing unit 700 in the balancer housing base 94 along a direction of arrow B in FIG. 9, an interference occurring between the driving gear 800, which is provided in the balancing unit 800, and the plurality of teeth gear 93, which are installed in the balancer housing 90 to have the form of a rack gear form or a ring gear form, may be prevented from occurring due to the first inclination 932 and the second inclination 934, which are formed on balancer housing 90. This is because the first inclination 932 performs the function of a guiding surface, which is configured to guide the driving gear 800. Additionally, the second inclination 934 configuring the boundary of the first inclination 932, which is configured of two inclined surfaces, may also perform a function of a guiding unit guiding the driving gear 800, so that the driving gear 800 can be interlocked with the gear teeth 93 without any interference.

FIG. 11 illustrates a graph showing a change in voltage being measured from a coil, which is provided on an outer circumferential surface of a tub.

Although it is not shown in the drawings, a first coil may be provided in tub 20, which is described above with reference to FIG. 4 through FIG. 8. And, the first coil may be configured to have a predetermined electric current flowing therein by being supplied with power from an external power source. More specifically, the first coil may be configured to supply a pre-decided voltage form an external power source.

Additionally, the second balancing unit 700 may be provided with a second coil. As shown in FIG. 11, the first coil is represented as a Tx coil, and the second coil is represented as a Rx coil.

For example, a balancer housing 90 for balancing unit 700 may be installed at the front portion of drum 30, and at least one or more second coils may be provided to the front portion of tub 20, which is respective to balancer housing 9. Accordingly, when balancing unit 700, which can be moved within balancer housing 90 passes through a location of the second coil, which is provided in tub 20, the controller (not shown), which is installed in the laundry machine, may measure a change in the voltage of the second coil occurring due to the electromagnetic induction and may, then, determine the location of balancing unit 700.

More specifically, at least one or more of the first coils (i.e., Tx coils) may be provided on a specific location of a front circumference of tub 20. For example, at least one or more first coils may be installed on the front circumference of tub 20, which is respective to the location of balancer housing 90 having drum 30 installed therein. Such first coil may be supplied with power from an external power (not shown), and, generally, the first coil may be configured to receive a voltage of approximately 1 volt. Additionally, balancing unit 700 may also be provided with a second coil (e.g., Rx coil), which is not connected to power.

Furthermore, balancing unit 700 may rotate along with drum 30, while being fixed to a predetermined location within balancer housing 90, or balancing unit 700 may actively move (or move on its own) within balancer housing 90 regardless of the rotation of drum 30. At this point, when balancing unit 700 passes through a location where the first coil is installed in tub 20, there may occur a moment when the first coil overlaps with the second coil, which is provided in balancing unit 700. Accordingly, an electric current may flow into the second coil due to an electromagnetic field of the first coil. Therefore, at the moment when the first coil provided in tub 20 overlaps with the second coil provided in balancing unit 700, the voltage being supplied to the first coil shall be greater than the pre-decided voltage. For example, although the first coil is generally configured to be supplied with a voltage of approximately 1 volt, at the moment when the first coil overlaps with the second coil, the voltage being supplied to the first coil may be increased to approximately 3 volts.

At this point, the controller (not shown) may be configured to consistently check the voltage being supplied to the first coil, and the controller (not shown) may determine a moment when the voltage being supplied to the first coil becomes greater than a pre-decided voltage, which is being supplied by the power source. More specifically, the controller may detect a moment when the one or more first coils being provided at a predetermined location on the circumference of tub 20 overlap with the second coil being provided in balancing unit 700, and, then, the controller may determine the location of balancing unit 700.

It will be preferable that such location of balancing unit 700 is detected or determined at an initial operation of drum 30. For example, when drum 30 begins to rotate (or within a predetermined period of time after the rotation of drum 30 has started), it will be preferable for the controller to detect the location of balancing unit 700 by using a change in voltage in the first coil, which is caused by the electromagnetic induction of the second coil.

More specifically, when drum 30 begins to rotate in order to perform washing, rinsing, or spinning, it will be preferable for the controller to detect the location of the balancing unit 700 by using the change in voltage in the first coil, which is caused by the electromagnetic induction of the second coil. After determining the location of balancing unit 700 during the low-speed rotation section of drum 30, this is to move balancing unit 700 to a location that can alleviate the eccentric rotation of drum 30, when drum 30 performs an eccentric rotation. More specifically, as described above, during the low-speed rotation of drum 30, balancing unit 700 is fixed to a predetermined location within balancer housing 90, and balancing unit 700 also rotates along with the rotation of drum 30. Accordingly, there may occur a moment when the first coil, which is provided on a predetermined location within the circumference of tub 20, overlaps with the second coil, which is provided in balancing unit 700. More specifically, when balancing unit 700 rotates along with the rotation of drum 30, there may occur a moment when the first coil, which is provided on a predetermined location within the circumference of tub 20, crosses over the second coil, which is provided in balancing unit 700. At this point, the controller may detect a change in the voltage (i.e., increase in voltage) being supplied to the first coil, so as to determine that balancing unit 700 has passed the location of the first coil. More specifically, the controller being provided in the laundry machine may detect a difference in voltage being measured from the first coil, so as to determine the location of balancing unit 700.

Additionally, by determining the rotation speed of drum 30 and a time point when balancing unit 700 has passed the location of the first coil, the controller may determine an angular position of balancing unit 700.

Therefore, when vibration and noise are generated due to a concentration of the laundry 1 at a specific area within drum 30 and due to an eccentric rotation caused by an increase in the rotation speed of drum 30, the controller may determine a current location of balancing unit 700 and may then alleviate the eccentric rotation of the drum by moving balancing unit 700 to a location opposite to the laundry 1, thereby reducing the vibration and noise.

As described above, the laundry machine according to the present invention has the following advantages. According to the present invention, the movements of the balancing unit, which is provided on an outer circumference of the drum, may be actively controller. Additionally, when the drum rotates at a low speed (i.e., 0 to 150 RPM), the location of the balancing unit may be fixed in the balancer housing, wherein the balancing unit can move. Moreover, when the drum rotates at a high speed (i.e., 600 to 800 RPM), the location of the balancing unit may also be fixed in the balancer housing, wherein the balancing unit can move. Finally, when installing the balancing unit in the balancer housing, interference occurring between the driving gear of the balancing unit and the gear teeth provided in the balancer housing may be prevented or minimized.

It will be apparent to those skilled in the art that various modifications and variations can be made in the present invention without departing from the spirit or scope of the inventions.

What is claimed is:

1. A laundry machine, comprising:

a cabinet forming an exterior appearance of the laundry machine;

a tub provided inside the cabinet;

a drum rotatably provided inside the tub;

a balancer housing coupled to a front portion or a back portion of the drum;

a balancing unit movably formed inside the balancer housing; and one or more first coils provided on the tub and supplied with a pre-decided voltage from an external power source, wherein the balancing unit comprises:

a body forming an exterior of the balancing unit, a second coil provided in the balancing unit, and a controller provided in the laundry machine and detecting a difference in voltage measured from the first coil, wherein the body includes a first cutout section formed on a first horizontal end portion of the body, a first mass body on one lateral side of the first horizontal end portion of the body based upon the first cutout section, and a first wheel on another lateral side of the first horizontal end portion of the body based upon the first cutout section, the body configured to roll within the balancer housing, wherein an elastic member is provided between the first mass body and the first wheel, so as to push the first mass body and the first wheel to both lateral sides of the body, and wherein, when the balancing unit passes a location where one of the one or more first coils is positioned based upon the rotation of the drum, the controller detects a difference in voltage measured from the first coil caused by the second coil, and thereby determines a location of the balancing unit.

2. The laundry machine of claim 1, wherein a first supporting member rotatably supporting the first wheel is provided in the body, and wherein each end portion of the elastic member is respectively installed on the first mass body and the first supporting member.

3. The laundry machine of claim 1, wherein, in the body of the balancing unit, a protrusion is formed on the lateral side of the body being provided with the first mass body towards an inner circumferential surface of the balancer housing.

4. The laundry machine of claim 1, wherein a hollow second cutout section is formed on a second horizontal end portion of the body, and wherein a second mass body is provided on one lateral side of the second horizontal end portion of the body based upon the second cutout section, and wherein a second wheel is provided on another lateral side of the second horizontal end portion of the body.

5. The laundry machine of claim 4, wherein the body is provided with a second supporting member rotatably supporting the second wheel.

6. The laundry machine of claim 4, wherein the second cutout section includes a second slit being extended to a predetermined width starting from the second horizontal end portion of the body and toward the first horizontal end portion of the body, and a second elastic hole on one end portion of the second slit with a width larger than a width of the second slit.

7. The laundry machine of claim 6, wherein the second slit and the second elastic hole pass through the body of the balancing unit along a thickness direction.

8. The laundry machine of claim 4, wherein the balancing unit further comprises:

a driving motor being provided in the second mass body; and a driving gear receiving a driving force from the driving motor.

9. The laundry machine of claim 8, wherein a plurality of gear teeth is formed along an inner circumferential surface of the balancer housing, and wherein the driving gear interlocks with the gear teeth of the balancer housing.

10. The laundry machine of claim 8, wherein the balancing unit further comprises:

one or more gears between the driving motor and the driving gear in order to deliver a driving force supplied by the driving motor to the driving gear.

11. The laundry machine of claim 8, wherein an opening is formed on one side surface of the body, and wherein the driving gear is exposed to an outside of the body through the opening.

12. The laundry machine of claim 1, wherein the first cutout section includes a first slit being extended to a predetermined width starting from the first horizontal end portion of the body toward the second horizontal end portion of the body, and a first elastic hole on one end portion of the first slit with a width larger than a width of the first slit.

13. The laundry machine of claim 12, wherein the first slit and the first elastic hole pass through the body of the balancing unit along a thickness direction.

14. The laundry machine of claim 1, wherein the balancer housing is provided along an inner circumferential surface or an outer circumferential surface of a front portion of the drum.

15. The laundry machine of claim 1, and wherein, when the balancing unit passes a location where one of the one or more first coils is located, an electric current is generated in a second coil due to an electromagnetic field of the first coil, thereby causing the voltage being supplied to the first coil to be greater than the pre-decided voltage.

16. The laundry machine of claim 1, wherein one or more first coils are provided on an external circumference of the tub relative to the balancer housing being provided along an external circumference of the drum, and wherein, when the balancing unit actively moves within the balancer housing and passes a location where one the one or more first coils is located, a controller provided in the laundry machine detects a difference in voltage measured from the first coil, thereby determining a location of the balancing unit.

17. The laundry machine of claim 16, and wherein, when the balancing unit passes a location where one of the one or more first coils is located, an electric current is generated in a second coil due to electromagnetic induction, thereby causing the voltage being supplied to the first coil to be greater than the pre-decided voltage.

18. The laundry machine of claim 1, wherein the elastic member corresponds to a coil spring, and wherein a first supporting member rotatably supporting the first wheel is provided in the body, and wherein each end portion of the coil spring is respectively installed on the first mass body and the first supporting member.

* * * * *